US005803352A

United States Patent [19]

Spaulding

[11] Patent Number: 5,803,352

[45] Date of Patent: Sep. 8, 1998

[54] TWO WAY MAILER

[76] Inventor: Lincoln Brooks Spaulding, 7 Oakshade Ave., Darien, Conn. 06820

[21] Appl. No.: 773,650

[22] Filed: Dec. 24, 1996

[51] Int. Cl.[6] ..... B65D 27/04

[52] U.S. Cl. ..... 229/304

[58] Field of Search ..... 229/304, 305

[56] References Cited

U.S. PATENT DOCUMENTS

| | | | |
|---|---|---|---|
| 769,536 | 9/1904 | Dixon . | |
| 886,449 | 5/1908 | West . | |
| 1,324,100 | 12/1919 | Binkowitz . | |
| 1,960,054 | 5/1934 | Johnson . | |
| 2,289,460 | 7/1942 | Sacks . | |
| 2,317,335 | 4/1943 | Whitman | 229/305 |
| 2,673,680 | 3/1954 | Deutschmeister et al. . | |
| 2,686,005 | 8/1954 | Hyman . | |
| 2,759,658 | 8/1956 | Sawdon . | |
| 2,760,717 | 8/1956 | Wyatt . | |
| 2,872,099 | 5/1959 | Prial . | |
| 2,928,583 | 3/1960 | Law . | |
| 2,964,233 | 12/1960 | McFarland . | |
| 2,983,431 | 5/1961 | Turan . | |
| 2,984,403 | 5/1961 | David . | |
| 3,084,846 | 4/1963 | Clegg . | |
| 3,086,695 | 4/1963 | Lillibridge . | |
| 3,113,716 | 12/1963 | Howard . | |
| 3,152,751 | 10/1964 | Hiersteiner . | |
| 3,184,150 | 5/1965 | Hubbard . | |
| 3,558,040 | 1/1971 | Kruger . | |
| 3,652,007 | 3/1972 | MacDougall . | |
| 3,802,618 | 4/1974 | Wiessner . | |
| 3,908,892 | 9/1975 | Pelzer . | |
| 4,308,987 | 1/1982 | Solomon . | |
| 4,382,539 | 5/1983 | Kronman . | |
| 4,487,360 | 12/1984 | Fisher et al. . | |
| 4,565,317 | 1/1986 | Kranz . | |
| 4,595,138 | 6/1986 | Kristel . | |
| 4,602,736 | 7/1986 | Barr . | |
| 4,688,715 | 8/1987 | Barr . | |
| 4,730,768 | 3/1988 | Gendron . | |
| 4,775,095 | 10/1988 | Emmott . | |
| 4,784,317 | 11/1988 | Chen et al. . | |
| 4,899,926 | 2/1990 | Spaulding . | |
| 5,071,167 | 12/1991 | O'Brien . | |
| 5,104,036 | 4/1992 | Rutkowski et al. . | |
| 5,169,061 | 12/1992 | Buescher | 229/305 |
| 5,267,687 | 12/1993 | Sherman . | |
| 5,282,568 | 2/1994 | File | 229/305 |

FOREIGN PATENT DOCUMENTS

| | | |
|---|---|---|
| 784432 | 7/1935 | France . |
| 21278 | of 0000 | United Kingdom . |
| 2117319 | 10/1983 | United Kingdom . |

*Primary Examiner*—Stephen P. Garbe

*Attorney, Agent, or Firm*—Samuels, Gauthier, Stevens & Reppert

[57] ABSTRACT

The invention provides a two way mailer formed of a single blank of sheet material including first and second sections, and a perforated line for separably interconnecting the first and second sections. The first section includes bottom, top and side edges, and a first fold line spaced inwardly from and parallel with the bottom edge. The first fold line defines front and rear portions of the first section. The second section includes rear and return panels, each including bottom, top and side edges. The bottom edges of the rear and return panels coincidently define a second fold line parallel with the first perforated line and about which the return panel may be folded onto the rear panel. The two way mailer also provides that the thus folded return panel may be adhered to the rear panel to thereby form a return envelope, and that the thus formed return envelope, together with the rear portion of the first section, is foldable about the first fold line onto the front portion of the first section and adhered thereto. The return envelope may then be separated from the first section along the first perforated line.

9 Claims, 7 Drawing Sheets

TWO WAY MAILER

BACKGROUND OF THE INVENTION

The invention generally relates to envelopes and in particular relates to two way mailer envelopes comprising a single blank of sheet material and formable into a forwarding envelope and a separable return envelope.

Conventional two way mailer envelopes typically include two or more sections that may be separated one from the other to permit a return envelope to be formed and sealed. For example, U.S. Pat. No. 4,899,926 shows a two way mailer envelope including first and second sections separated by a perforated line. The first section forms the front of the forwarding envelope, and the second section forms the return envelope which is folded at the perforated line onto the first section. Upon opening the forwarding envelope, the recipient bursts the first section from the second section along the perforated line.

It has been found that during automated envelope filling operations, the perforated line is sometimes breached by the machinery that fills the forwarding envelopes. The perforated line must therefore be sufficiently strong to withstand the automated filling operations, yet sufficiently tearable that the recipient will be able to expose the return envelope without great difficulty.

It is also desirable that the return envelopes of two way mailers include U.S. Postal Service facial identification markings (FIM) that Post Office mail handling and scanning machinery are able to locate and thereby identify the face and orientation of the article of mail. Certain conventional two way mailers include FIM markings on the return closure flap. The recipient is instructed to moisten and seal the return closure flap to enclose the return envelope. During this sealing process, the enclosure flap including the FIM markings sometimes becomes crooked or crumpled, making it difficult for Post Office automated scanning equipment to read the FIM markings. The FIM markings must also be a minimum size, requiring the return closure flap to be rather large.

When processing mail, the U.S. Post Office prints processing indicia generally on the left bottom edge of the reverse side of the envelope on at least certain types of mail. This indicia from the remote bar coding system (or RBCS) is typically printed in a florescent orange color, and indicates that the envelope has been processed. It is desirable that the RBCS tag line not be printed on any part of the two way mailer that will be used to form the return envelope. Otherwise the return envelope may be rejected or incorrectly processed.

It is an object of the invention to provide a two way mailer that is strong enough to easily withstand automated filling operations without bursting the perforated line separating the various sections, yet be easily tearable by the recipient to form the return envelope.

It is also an object of the present invention to provide a two way mailer having FIM markings that are likely to remain unaltered while the return envelope is being formed by the recipient.

It is a further object of the invention to provide a two way mailer in which RBCS information printed by the Post Office on the forwarding envelope does not appear on any part of the return envelope.

SUMMARY OF THE INVENTION

The invention provides a two way mailer formed of a single blank of sheet material including first and second sections, and a perforated line for separably interconnecting the first and second sections. The first section includes bottom, top and side edges, and a first fold line spaced inwardly from and parallel with the bottom edge. The first fold line defines front and rear portions of the first section. The second section includes rear and return panels, each including bottom, top and side edges. The bottom edges of the rear and return panels coincidently define a second fold line parallel with the first perforated line and about which the return panel may be folded onto the rear panel.

The two way mailer also provides that the thus folded return panel may be adhered to the rear panel to thereby form a return envelope. The thus formed return envelope, together with the rear portion of the first section, is foldable about the first fold line onto the front portion of the first section. The two way mailer also provides that the thus folded return envelope may be adhered to the first section. The return envelope may then be separated from the first section along the first perforated line.

BRIEF DESCRIPTION OF THE DRAWINGS

The following detailed description may be further understood with reference to the accompanying drawings in which.

DETAILED DESCRIPTION OF THE ILLUSTRATED EMBODIMENTS

Figure 1:
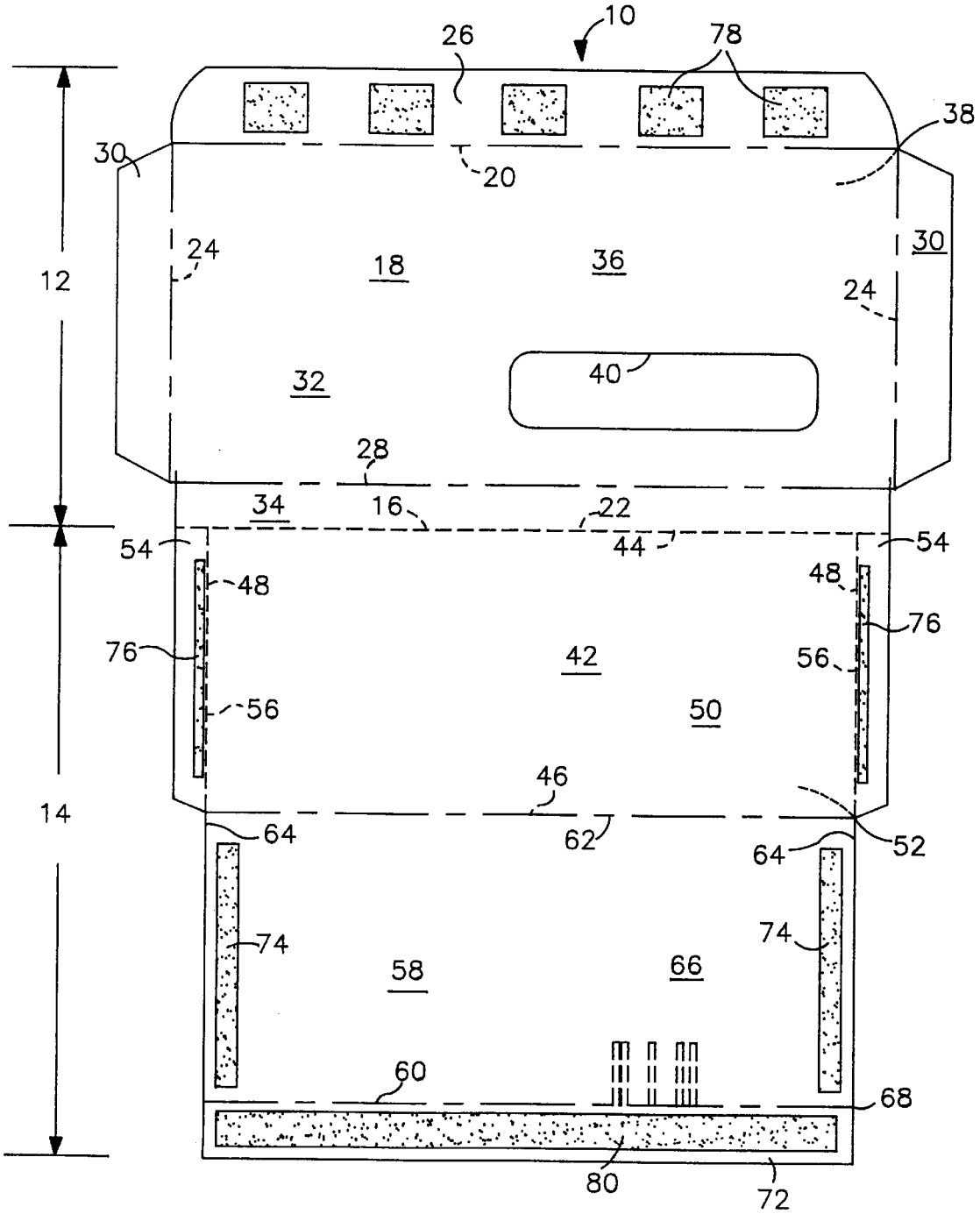
FIG. 1 is a plan view of a blank used to form a two way mailer of an embodiment of the invention.

As shown in FIG. 1, a two way mailer of the invention 10 includes two sections 12 and 14 separably connected by a perforated line 16. The first section 12 includes a front panel 18 having a top edge 20, a bottom edge 22 and side edges 24, and a front enclosure flap 26 extending outwardly from the top edge 20 of the front panel 18. The first section 12 also includes a first fold line coincident with the bottom edge 28 of the front panel 18 spaced inwardly from and parallel with the bottom edge 22 of the first section 12. The first fold line divides the first section into a front portion 32 and a rear portion 34. Side flaps 30 extend outwardly from the side edges 24 of the front panel 18. The front panel also includes an inside face 36 and an outside face 38, and may include a window 40 exposing material within the forwarding envelope. In further embodiments, additional windows may be employed to expose various portions of the contents of the forwarding and/or return envelope.

The second section 14 includes a rear panel 42 having a top edge 44, a bottom edge 46 and side edges 48, as well as an inside face 50 and an outside face 52. Side flaps 54 extend outwardly from the side edges 48 of the rear panel 42, and perforated lines 56 are coincident with the side edges 48 thereby defining the side flaps 54. The second section 14 also includes a return panel 58 having a top edge 60, a bottom edge 62, and side edges 64, as well as an inside face 66 and an outside face 68. The bottom edge 46 of the rear panel 42 and the bottom edge 62 of the return panel 58 coincidently define a fold line 70 about which the inside face 50 of the rear panel and the inside face 66 of the return panel 58 may be folded onto one another. A return enclosure flap 72 extends outwardly from the top edge 60 of the return panel 58.

Figure 2:
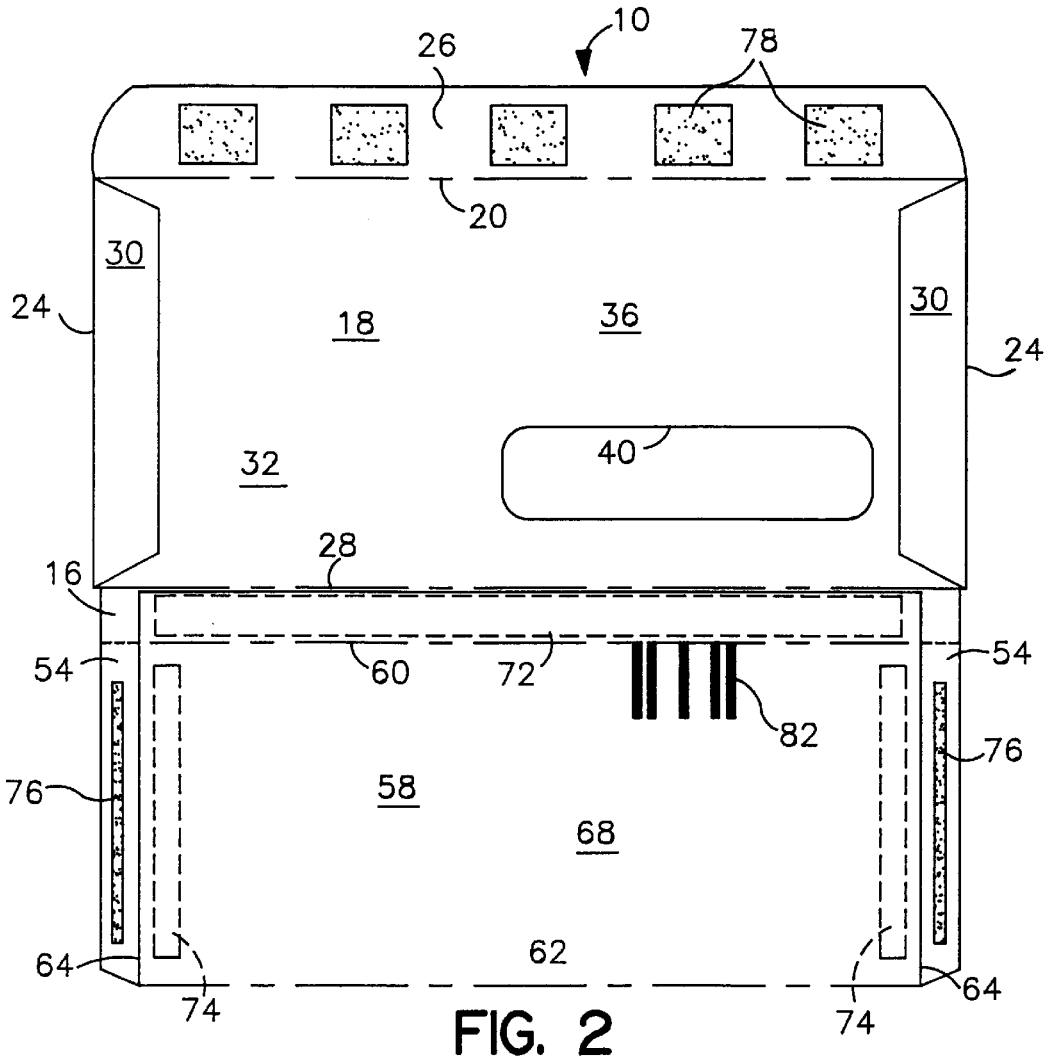
FIGS. 2–6 are views showing the sequential steps followed to form a two way mailer from the blank shown in FIG. 1.

As shown in FIG. 2, the side flaps 30 of the front panel 18 may be folded onto the inside face 36 of the front panel 18 about fold lines along the side edges 24. The inside face 66 of the return panel 58 may then be folded onto the inside face 50 of the rear panel 42. Adhesive 74, which is disposed on the inside face 66 of the return panel 58, is adhered to the inside face 50 of the rear panel 42 as shown in FIG. 2 thereby forming the return envelope. In other embodiments, adhesive may be disposed on the inside face 50 of the rear panel 42 for sealing with the inside face 66 of the return panel 58.

Figure 3:
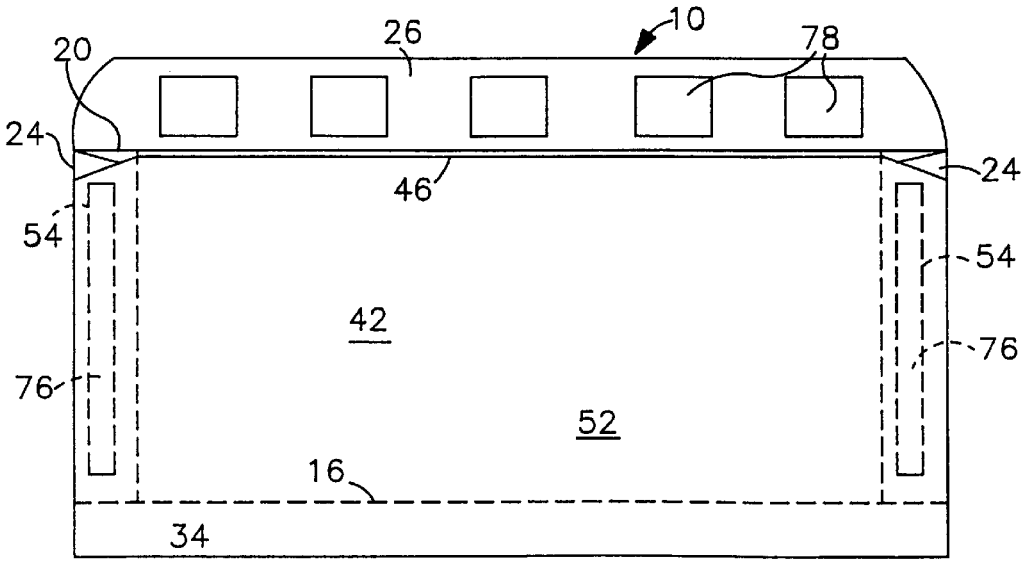
Figure 4:
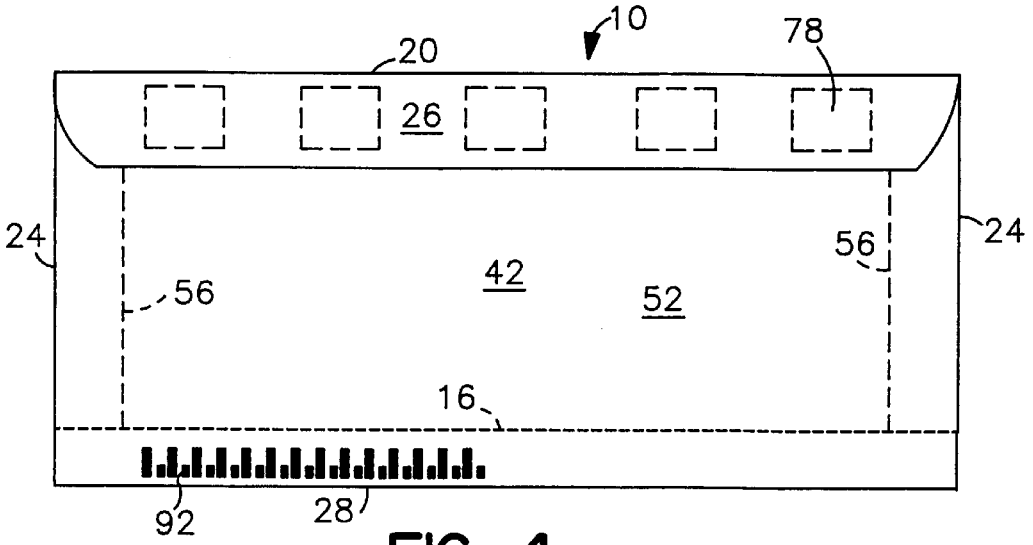

The return envelope, together with the rear portion 34 of the front panel 18 may be folded about the fold line 28 onto the inside face 36 of the front panel 18 as shown in FIG. 3. Adhesive 76 on the inside faces of side flaps 54 is adhered to the outside faces of folded side flaps 30 of the front panel as shown in FIGS. 2 and 3. Again, in other embodiments, adhesive may be disposed on the outside face of the side flaps 30 for sealing with the inside face 50 of the rear panel 42. The front enclosure flap 26 may then be folded about a fold line coincident with the top edge 20 of the front panel 18, and adhered via adhesive 78 to the outside face 52 of the rear panel 42, thus forming the forwarding envelope as shown in FIG. 4. The Post Office may apply RBCS data 92 to the bottom left edge of the reverse side of the forwarding envelope as shown in FIG. 4.

Figure 5A:
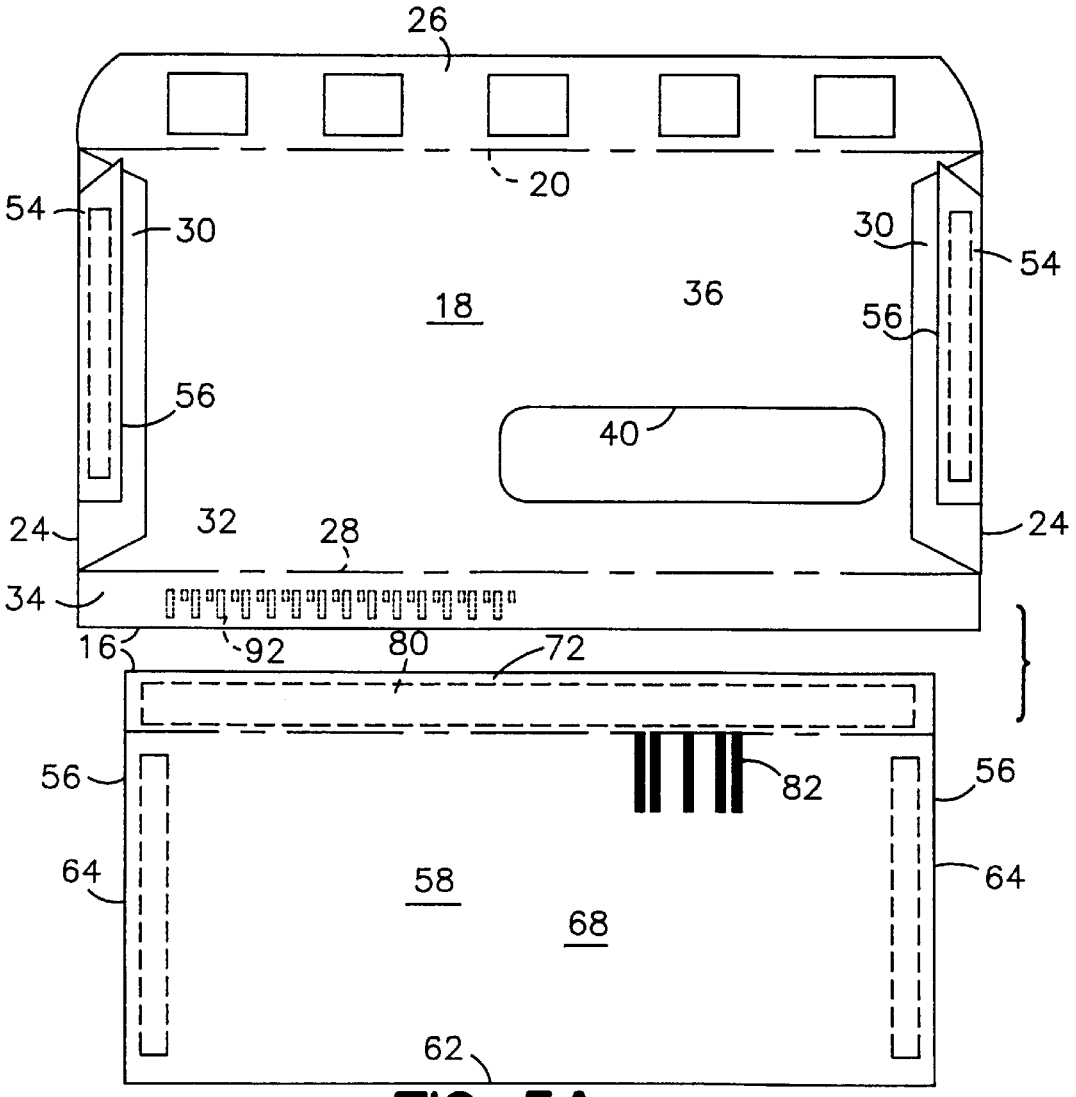
Figure 5B:
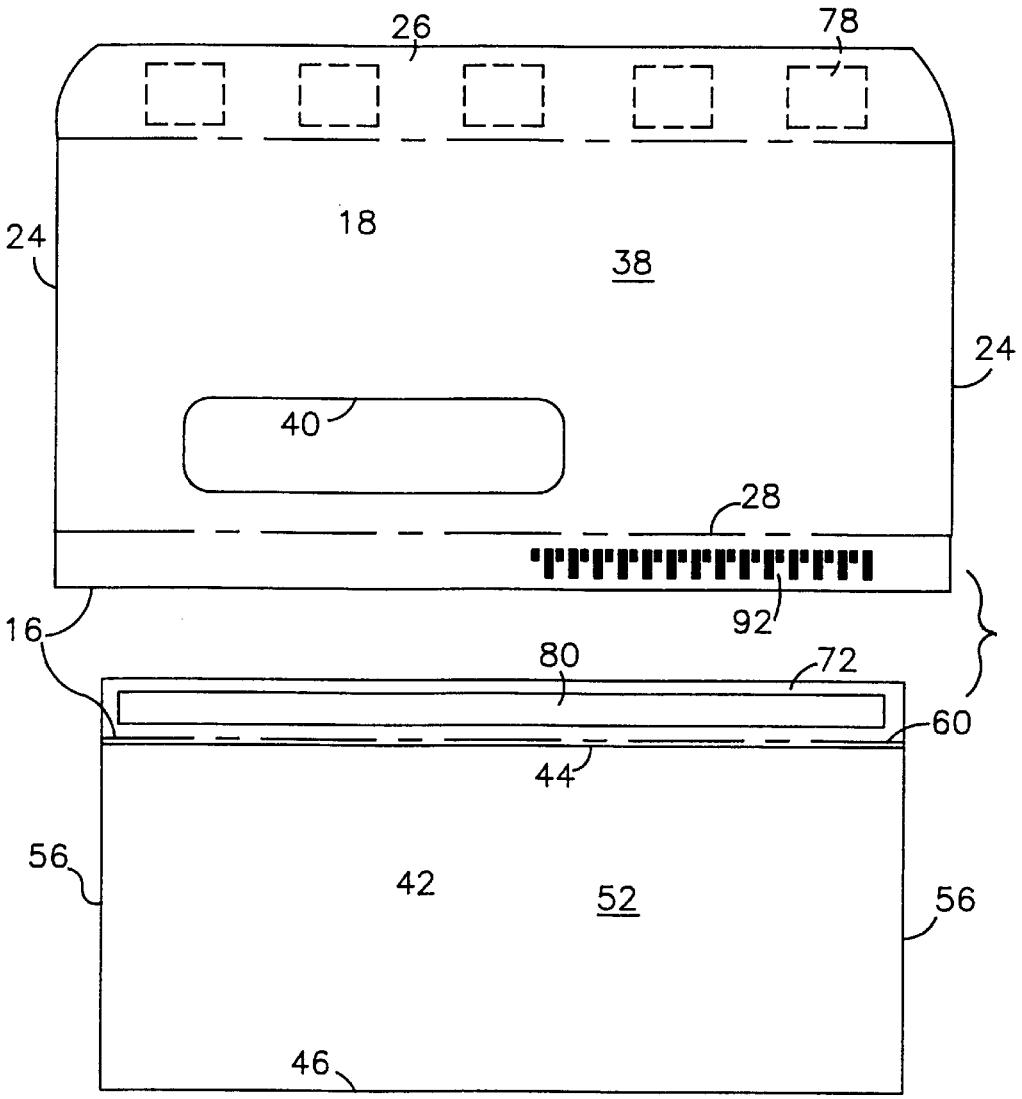

Upon receipt of the forwarding envelope, the recipient opens the envelope by first lifting the front enclosure flap 26, and separating the first and second sections from one another along perforated lines 16 and 56. FIGS. 5A and 5B show the two way mailer as it is opened from the front and back sides respectively. Note that the RBCS data 92 applied to the forwarding envelope is printed on the portion of the two way mailer that is discarded as shown in FIGS. 5*a* and 5*b*.

Figure 6:
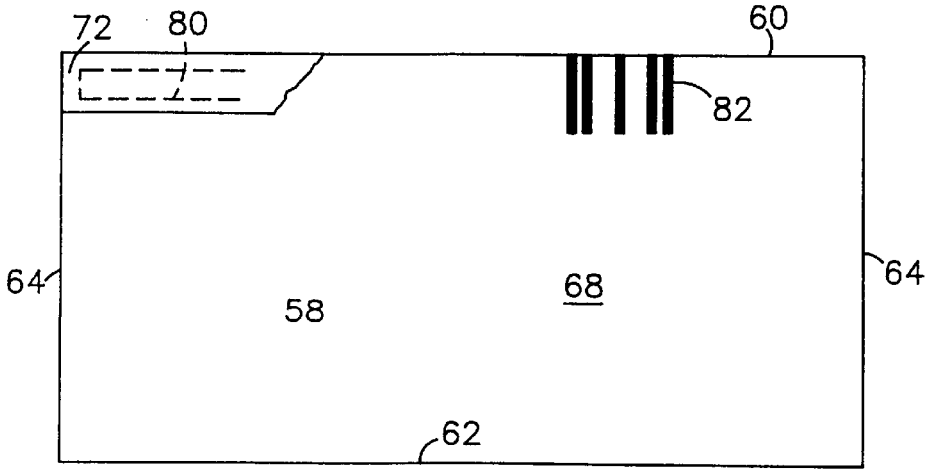

As shown in FIG. 6, the return enclosure flap 72 may then be folded about a fold line coincident with the top edge 60 of the return panel 58 to enclose the return envelope. Adhesive 80 is used to seal the enclosure flap 72 to the outside face 52 of the rear panel 42.

As shown in FIG. 6, FIM markings 82 are positioned on the outside face 68 of the return panel 58. Since the markings 82 are not printed on the return enclosure flap 72, it is unlikely that the FIM markings 82 will become obscured or unreadable by Post Office automated handling and scanning equipment when the recipient closes the return flap 72.

Figure 7:
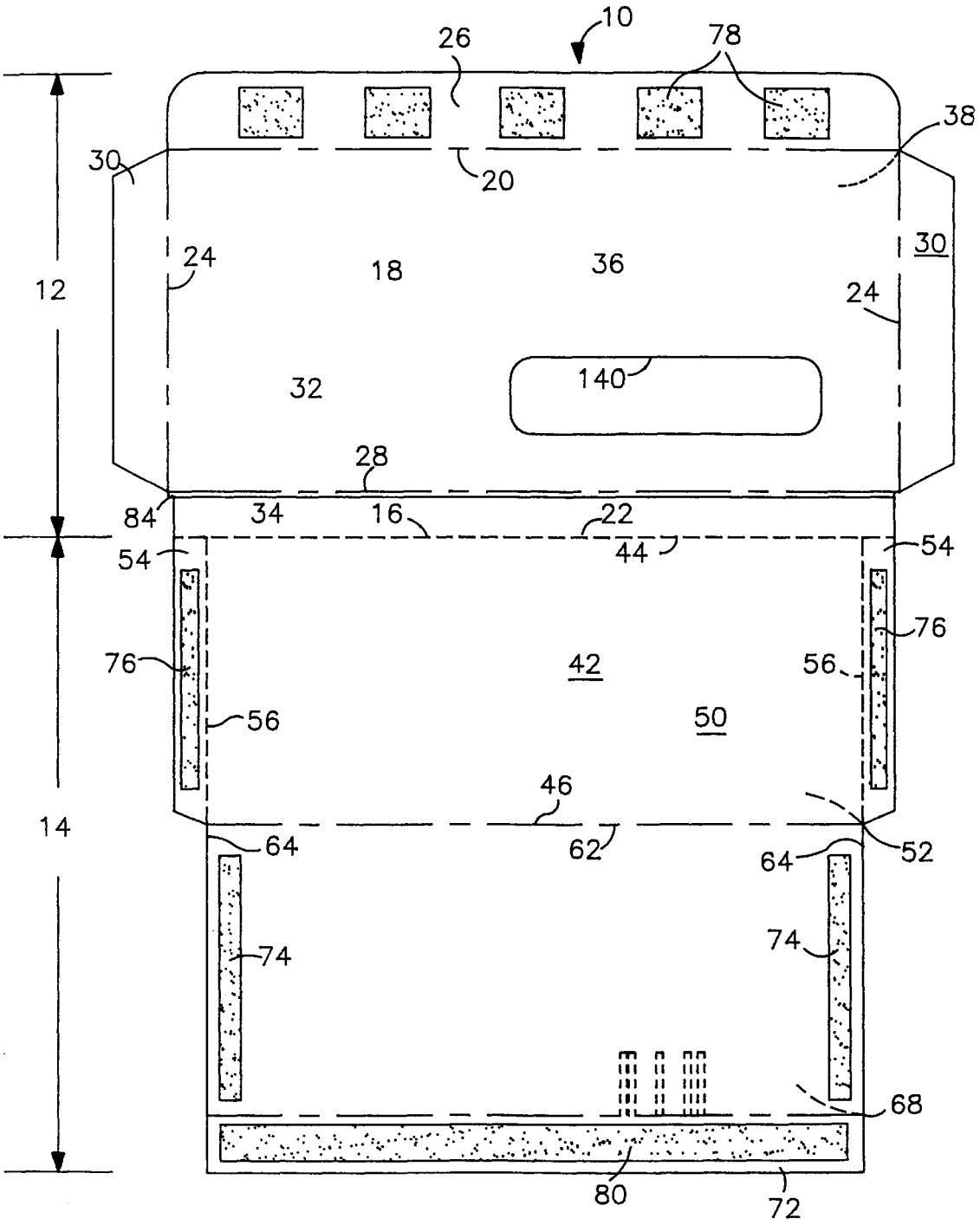
FIG. 7 is a plan view of a blank used to form a two way mailer of another embodiment of the invention.
Figure 8:
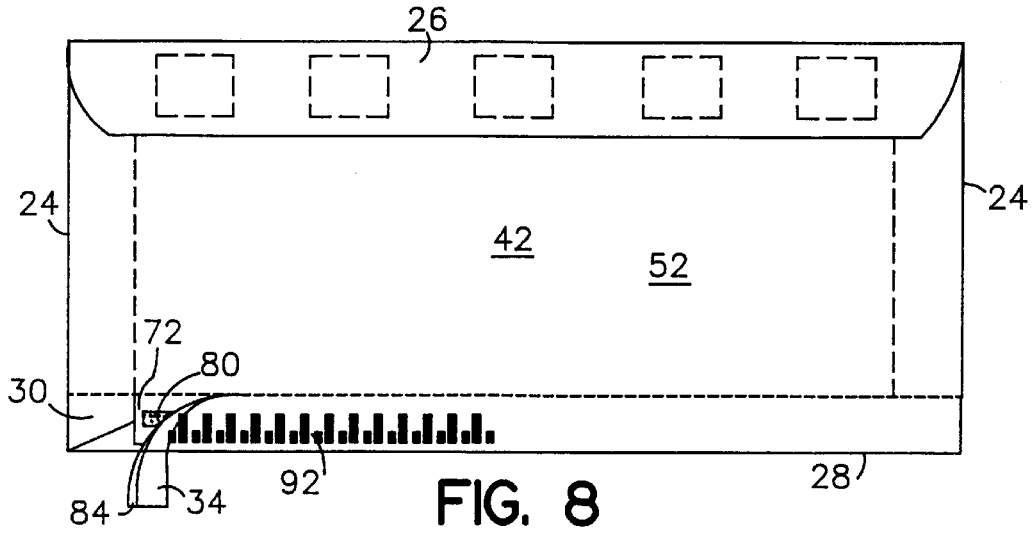
FIGS. 8 and 9 are views showing some of the sequential steps used to form the return envelope of the two way mailer shown in FIG. 7.
Figure 9:
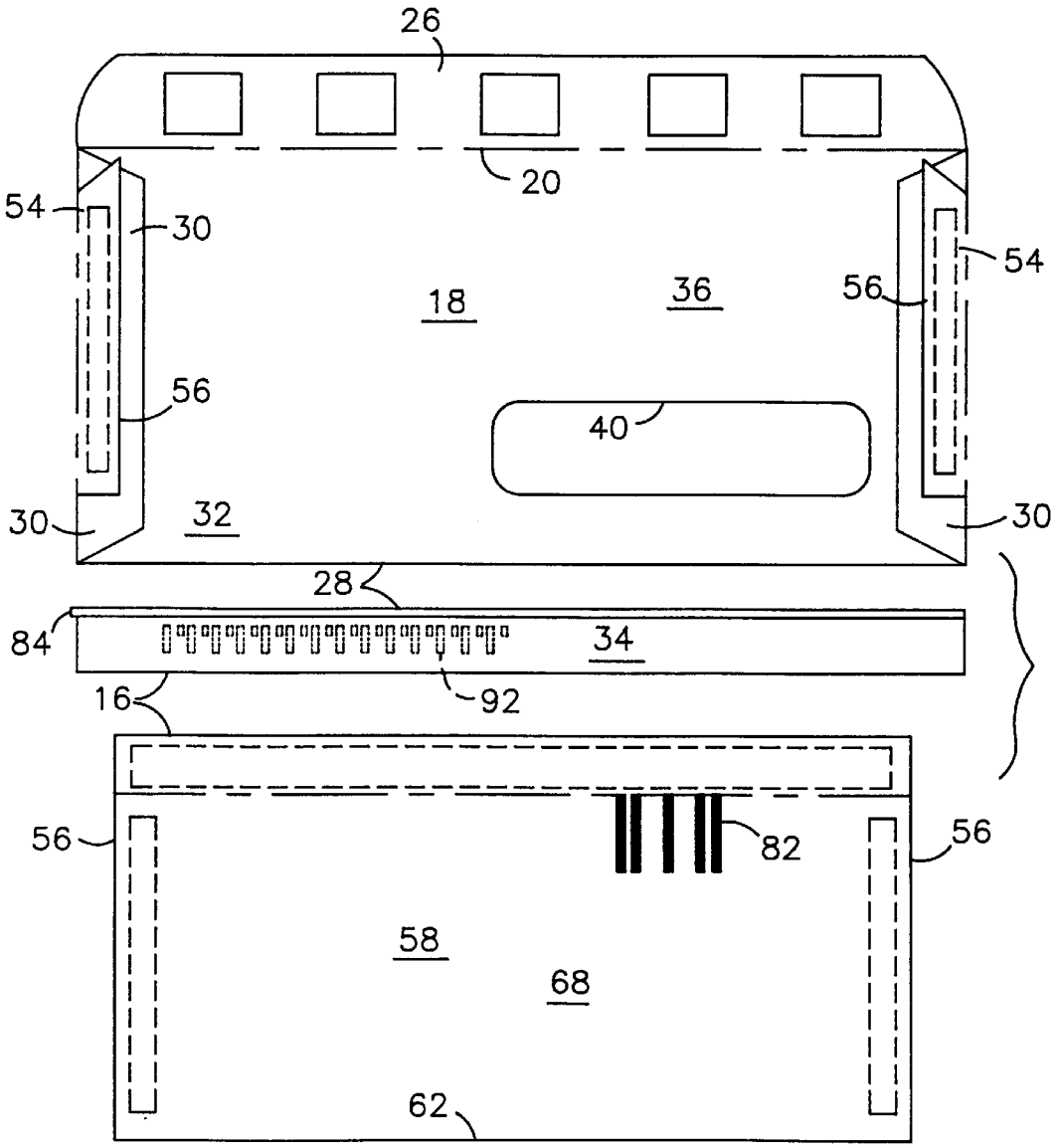

FIGS. 7–9 show another embodiment of the invention where elements similar to those described in connection with the embodiment shown in FIGS. 1–6 are referred to with the same numerals. In the embodiment shown in FIGS. 7–9, however, the rear portion 34 of the front panel 18 of the first section 12, further includes a tear strip 84. The tear strip 84 facilitates separation of the rear portion 34 of the front panel 18 from the front portion 32 along the fold line 28. The tear strip may be made of any suitable reinforced material such as string, thread, or any synthetic material. Note that, again, the RBCS data 92 applied to the forwarding envelope is printed on a portion of the two way mailer that is discarded as shown in FIGS. 8 and 9. In further embodiments, the tear strip may be omitted, and the fold line 28 itself may provide sufficient guidance for tearing the rear portion 34 from the front portion 32.

Figure 10:
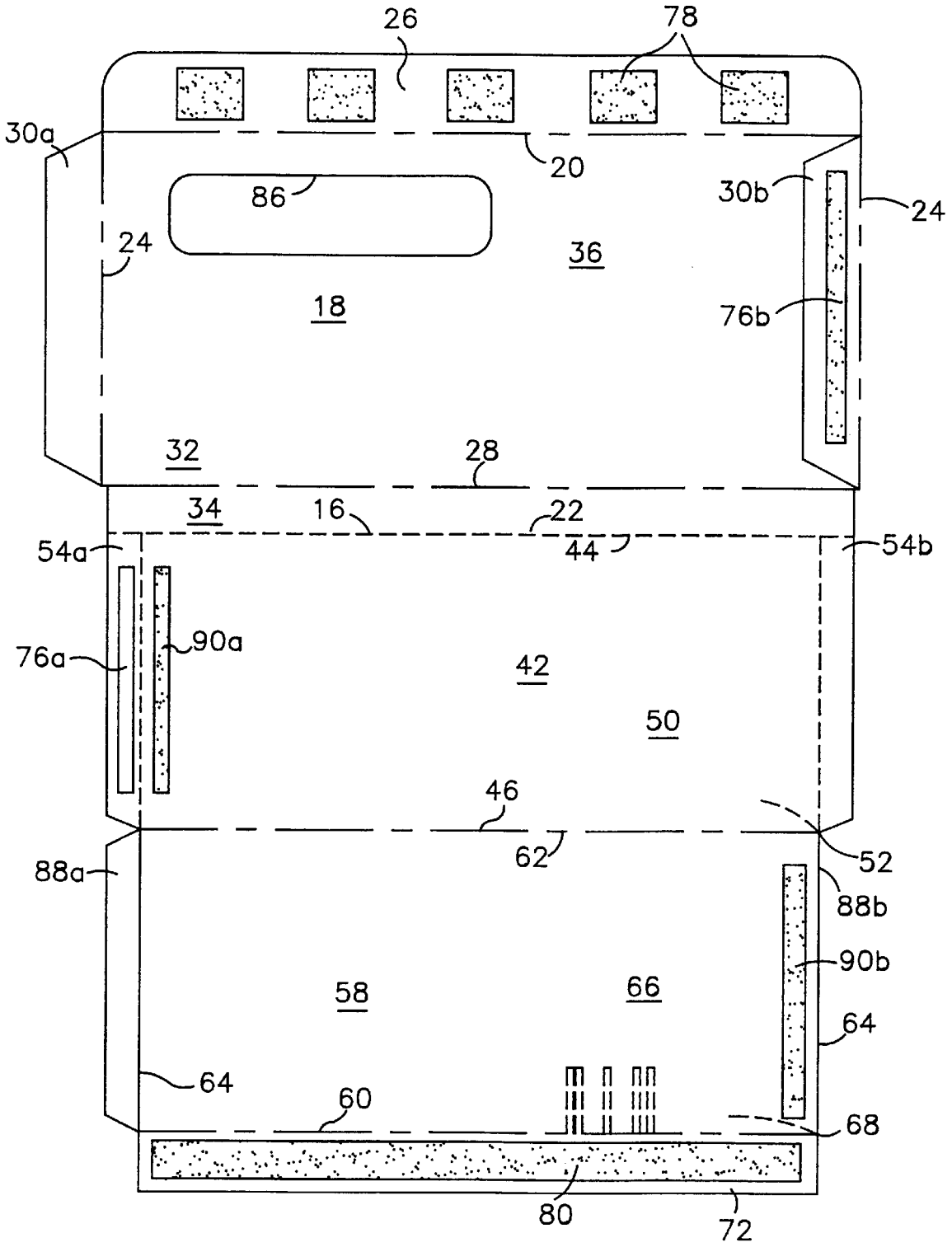
FIG. 10 is a plan view of a further embodiment of a two way mailer of the invention.

FIG. 10 shows further embodiments of the invention where elements similar to those described in connection with the embodiment shown in FIGS. 1–6 are referred to with the same numerals. In the embodiment shown in FIG. 10, however, the return envelope may be enclosed by using side flaps 88 which extend outwardly from the side edges 64 of the return panel. The side flaps 88 may be folded about a fold line coincident with the side edge 64 of the return panel 58. One of the side flaps 88*a* is shown open in FIG. 10, and the other side flap 88*b* is shown folded. When the return panel 58 is folded onto the rear panel 42, adhesive is employed to seal the side flaps 88 to the rear panel 42. The adhesive 90*a* may be positioned on the rear panel as shown, or adhesive 90*b* may be positioned on the outside of the side flap 88*b*. Both examples are illustrated in FIG. 10.

As also illustrated in FIG. 10, side flaps 30 of the front panel 18 may be adhered to the side flaps 54 of the rear panel as discussed above by adhering adhesive 76*a* on the flaps 54*a* to the flap 30*a* after it is folded. FIG. 10 also illustrates that the side flap 30*b* may be adhered to the side flap 54*b* through the use of adhesive 76*a* on the reverse side of the flap 30. Either way, when folded and sealed, the flaps join to form the forwarding envelope.

In the above disclosed embodiments, the blank of sheet material must be printed such that printing on the outside face 38 of the front panel 18 will be upside down with respect to printing on the outside face 68 of the return panel 58. Note that in FIG. 1 the bottom of the front face of the forwarding envelope is coincident with the bottom edge of the front panel, while the bottom of the front face of the return envelope is coincident with the bottom edge of the return panel which is upside down with respect to the front panel when the envelope is in blank form.

In the event that it is desirable to print the blank of sheet material such that all printing is oriented in one direction, a two way mailer of another embodiment of the invention may be formed as shown in FIG. 10, again where elements similar to those described in connection with the embodiment shown in FIGS. 1–6 are referred to with the same numerals. In this embodiment, commonly referred to as postage meter style, the window 86 is positioned in the opposite corner of the front panel 18. The outside face 38 of the front panel 18 may then be printed with the same orientation as the outside face 68 of the return panel 58. The front enclosure flap 26, however, of the forwarding envelope of this embodiment will close along the bottom edge of the forwarding envelope since the top edge 20 of the front panel 18 will become the bottom edge of the forwarding envelope. This is in contrast to the forwarding envelope shown in FIG. 4 in which the bottom edge of the forwarding envelope is the fold line 28. In either embodiment, the bottom edge of the return envelope is the coincident bottom edges 46 and 62 of the rear and return panels 42 and 58 respectively.

Those skilled in the art will appreciate that modifications and variations may be made to the above disclosed embodiments without departing from the spirit and scope of the invention.

What is claimed is:

1. A two way mailer formed of a single blank of sheet material, comprising:

first and second sections, and a first perforated line for separably interconnecting said first and second sections;

said first section including bottom, top and side edges, and a non-perforated first fold line spaced inwardly from and parallel with at least a substantial portion of the bottom edge of said first section, said first fold line defining front and rear portions of said first section, and said first section further including tear means for facilitating separation of at least a portion of said rear portion of said first section from said front portion of said first section;

said second section including rear and return panels, each including bottom, top and side edges, the bottom edges of said rear and return panels coincidently defining a second fold line parallel with said first perforated line and about which said return panel may be folded onto said rear panel;

first means for adhering the return panel to said rear panel to thereby form a return envelope, the return envelope, together with said rear portion of said first section, being foldable about said first fold line onto said front portion of said first section; and second means for adhering the return envelope to said first section, whereupon said return envelope may be separated from said first section along said first perforated line while said at least a portion of said rear portion of said first section is being separated from said front portion of said first section.

2. A two way mailer as claimed in claim 1, wherein said tear means includes an elongated fibrous material.

3. A two way mailer as claimed in claim 2, wherein said elongated fibrous material is located adjacent said first fold line.

4. A two way mailer as claimed in claim 1, wherein said tear means includes a synthetic material.

5. A two way mailer as claimed in claim 4, wherein said synthetic material is located adjacent said first fold line.

6. A two way mailer as claimed in claim 1, wherein said second means further includes side flaps extending outwardly from the side edges of said first section, side flaps extending outwardly from the side edges of said rear panel, and adhesive for adhering said first section side flaps to said rear panel side flaps.

7. A two way mailer as claimed in claim 1, wherein said second section further includes second perforated lines perpendicular with said first perforated line and being coincident with the side edges of said rear panel.

8. A two way mailer as claimed in claim 1, wherein said first means includes adhesive located on said rear panel side flaps.

9. A two way mailer as claimed in claim 1, wherein said first perforated line extends between and to said side edges of said first section.

* * * * *